United States Patent [19]

Zeren

[11] 4,099,720

[45] Jul. 11, 1978

[54] EXPANDING ARROWHEAD

[76] Inventor: Joseph D. Zeren, 390 Forest Ave., Boulder, Colo. 80302

[21] Appl. No.: 659,986

[22] Filed: Feb. 23, 1976

[51] Int. Cl.[2] ..... F41B 5/02

[52] U.S. Cl. ..... 273/106.5 B

[58] Field of Search ..... 273/106.5 B, 106.5 R; 30/346, 356; 43/6

[56] References Cited

U.S. PATENT DOCUMENTS

| | | | |
|---|---|---|---|
| 49,263 | 6/1916 | Ellery | 30/346 X |
| 1,775,380 | 9/1930 | Wilson | 30/346 X |
| 2,568,417 | 9/1951 | Steinbacher | 273/106.5 B |
| 2,820,634 | 1/1958 | Vance | 273/106.5 B |
| 2,859,970 | 11/1958 | Doonan | 273/106.5 B |
| 3,014,305 | 12/1961 | Yorchich | 273/106.5 B X |
| 3,578,328 | 5/1971 | Rickey | 273/106.5 B |
| 3,600,835 | 8/1971 | Hendricks | 273/106.5 B |
| 3,738,657 | 6/1973 | Cox | 273/106.5 B |

*Primary Examiner*—Paul E. Shapiro
*Attorney, Agent, or Firm*—Earl C. Hancock

[57] ABSTRACT

Pivotally mounted blades within slots of a housing for an arrowhead are retracted for minimum outward extension during flight but expanded and retained in outwardly extended position upon impact with a target. The blades are retained in the retracted position by frictional engagement with the slots or by frangible or resilient members. The slot mounting of the blades permits forward pivoting relative to the arrow shaft to facilitate withdrawal from the target. The amount of outward extension of the blades upon impact is determined by a rearwardly positioned shoulder. This shoulder can be the rearward portion of the blade mounting slot or can take the form of a sleeve at the rear of the blade slots. The sleeve can further have shoulders of differing depths to allow preselection of the angle of outward extension of the blade upon impact via movement between the sleeve and the blade mounting body or housing. Minimal size with maximum blade mounting strength can be obtained by orienting the blade mounting slots within the body in an offset relation to the central axis thereof. The blades are retained by transverse set screws, retaining pins or the like for easy attachment or removal. By arranging the blade mounting body for telescopic movement within the camming sleeve, the blades can be retracted in a rearwardly oriented direction along the arrow shaft during inflight. The blades can be retained in a forwardly oriented direction by a frictional engagement means, an elastic or frangible band, slotted frangible cap or the like.

30 Claims, 22 Drawing Figures

EXPANDING ARROWHEAD

BACKGROUND OF THE INVENTION

The present invention relates to arrowheads attachable to the end of a shaft and including a blade mounting assembly which allows retraction and extension of the blades relative to the outer perimeter of the arrowhead. More particularly, the present invention relates to arrowheads attachable to a shaft and including outwardly movable blades arranged for minimum extension during flight and maximum extension upon impact at a target. A significant utility for the present invention is in hunting of large game animals with arrows in a manner which maximizes the probability of killing of the target animal but is humanely adapted for permitting the animal to withdraw the arrow in the event that a kill is not effected.

Conflicting requirements are placed upon the arrows to be used by an archer when hunting game animals, fish and the like. While in flight, the diameter of the arrowhead should be minimal to increase flight stability especially when used in a bow with heavy draw weight. However, it is extremely difficult to bring down a large animal with an arrowhead having such a small diameter. Some broad heads using fixed, outwardly extending blades of a larger diameter have been developed to increase the cutting size upon impact but the extended blades significantly decrease the in-flight stability. That is, such broad heads tend to plane or wobble and are especially sensitive to wind thereby significantly discounting accuracy of the archer as the distance from the target increases. Accordingly, there have been several arrowheads developed for the intended purpose of retaining the blades in a retracted position during flight but expanding those blades into a larger cutting diameter at or after impact on the target.

Several of the prior art developments have been directed towards arrangements wherein blades are pivotally mounted and adapted for forward extension relative to the arrow shaft during flight but pivoted into an outwardly extended position upon impact. Examples of such devices are in U.S. Pat. Nos. 2,568,417 by Steinbacher, 2,820,634 by Vance, 2,993,697 by Urban and 3,578,328 by Rickey. Such devices as those shown by Steinbacher, Vance and Rickey include extensions on the blade which engage the target and expand into the outwardly extended position after entry into the target. Urban employs a pivotal linkage arrangement for outwardly extending the cutting blades which are likewise pivotally attached at their points. Arrows impacting a game animal do not always kill that animal which sometimes escapes. In fact, it has been suggested that less than twenty percent of the game animals hit by arrows are actually captured by the hunter. Accordingly, for humane and conservation reasons, it is imperative and even a legal requirement in some jurisdictions that arrowheads be removable by the animal so as to reduce further internal injury and infection and allow natural healing to prevent waste of that animal. Although some of the prior art devices accommodate withdrawal of the arrow by the animal, the arrowheads frequently do not produce a large external wound but only expand after entry into the target which means that the animal may eventually die from internal hemorrhaging but will not leave a blood trail to permit the hunter to retrieve the carcass. Therefore, it is not only imperative that the cutting blades of the arrowhead be expandible upon impact from an in-flight retracted position but that this expansion be effected immediately upon impact so as to produce a large external wound.

Other prior art arrowhead developments have been directed towards mechanisms for retaining the cutting blades in a backwardly folded retracted position during flight with outward expansion upon or after impact with the target. Examples of such devices are shown in U.S. Pat. Nos. 2,859,970 by Doonan, 3,014,305 by Yurchich, 3,036,396 by Swails and 3,738,657 by Cox. Unfortunately, the backward folded blade configurations of the prior art do not meet the requirements of permitting retraction of the arrowhead by the animal at least not without creating substantial additional internal injury to the animal since the blades are retained against any forward pivoting thereof. Still further, such backwardly folded blade arrowhead configurations frequently involve relatively complex internal mechanisms and thus are not well suited for component replacement in the field. Although Doonan shows internal camming cones for forcing the blades into the outwardly extended position, these blades cannot be forwardly pivoted to allow extraction by the animal and further the camming mechanism and blade mounting is relatively weak because of the internal camming apparatus and the arrangement for blade mounting therein. Furthermore, an arrowhead of the Doonan type using an internal camming plunger can only employ two blades mounted in a common pin. However, it has been found in practice that preferably at least three blades should be included to improve flight stability while increasing the effective cutting area on impact.

Accordingly, there has been a continuing need in the prior art for an arrowhead which retains the cutting blades in minimal outwardly extended position during flight but which can be outwardly expanded upon impact to create a maximum external cutting at the target while accommodating forward pivotal movement of the blades as for extraction by an animal. Still further, there has been a continuing demand for such an arrowhead assembly using expandible/retractible blades with relatively simple but easily replaced components in the field. The need for such an arrowhead which is of minimal weight but fabricated from reliably operable elements for long term usage likewise exists. Still further, there has been a continuing need for an expandible arrowhead which permits field selection of the amount of outward blade pivoting upon impact.

SUMMARY OF THE INVENTION

The present invention relates to an arrowhead which employs pivotally mounted blades retractible for minimal diametric extension so as to provide in-flight stability but outwardly expandible upon impact at a target for maximum cutting upon entry into the target. More particularly, the present invention is an arrowhead attachable to the end of an elongated arrow shaft for impacting a target and which uses one or more elongated flat cutting blades. The arrowhead includes an elongated body which is attachable at one end to the end of the arrow shaft with the length of this body being in extended alignment with the length of the arrow shaft. The body has as many arcuate slots as there are blades with these slots opening thereinto generally parallel to the length of the body with the slots being dimensioned for internally receiving one end of a blade. The blade or blades are pivotally mounted at one end within the slot so that forward and rearward pivoting in extended relation to the length of the arrow shaft can be realized. However, the slot or slots include an arrangement at the end closest to the shaft attachment for cooperating with an edge of the blade so as to block the blade from rotating around its pivotal mounting toward the body attachment and when the blade is in an externally extending orientation relative to the body. Conversely, the slot is arranged in the portions opposite the arrow shaft attachment relative to the pivotal attachment for this blade or blades to allow rotation in a direction away from the arrow shaft and into a position generally parallel to the length of the body thereby facilitating removal of the arrow shaft and the attached arrowhead from the target.

As will be more evident from the subsequent detailed description of the exemplary preferred embodiments, the arrowhead can include any of a variety of arrangements for holding the blade against rotation around its pivotal mount and in a position such that the elongated edges of the blade are generally parallel to the length of the mounting body and the arrow shaft. Preferably, the holding arrangements are responsive to axial forces in the direction of the length of the body resulting from impact with the target for releasing the blades for rotation about the pivotal mounts. This holding arrangement can take the form of resilient or yieldable bands in surrounding relation to the blades and retained in notches therein, can be through frictional engagement with the blade pivotal mounting pin or screw, can be through frictionally engaging nubs or the like or in any desirable form.

One particularly unique feature of the present invention relates to the arrangement of the blade mounting slots in an offset relation but generally parallel to the central axis of the mounting body. This configuration maximizes blade retention strength while still allowing minimum arrowhead size and weight.

Yet another unique feature of the present invention is in the use of a hollow collar or sleeve attached as a lengthwise extension on the end of the arrow shaft and arranged to telescopically receive a piston member of the blade mounting body so that the collar can be forced into engagement with an edge of the blade to cam them into the outwardly extending position. This feature is particularly advantageous as compared to internal camming plunger devices used in prior art broad heads such as is shown in Doonan U.S. Pat. No. 2,859,970 mentioned above since the cam contact point between the sleeve and blade in accordance with this feature is at an optimum radial distance from the blade pivot point. Thus an ideal mechanical advantage for forcing the blade outward is realized. In addition, this configuration easily accommodates pivotal mounting of three or more blades as is particularly desirable for many applications.

When hunting with arrows, the archer frequently is faced with differing angles relative to the game animal and thus differing demands upon the optimum amount of blade extension upon impact. The hunter who has a full side shot at a target would prefer to have maximum blade extension available whereas, for angled, front or rear shots, would preferably utilize a smaller cutting diameter with lower blade extension angles so as to allow deeper penetration through thicker portions of the animal. Accordingly, a still further unique feature of the present invention relates to the use of a blade camming collar which is mounted relative to the mounting body for rotary movement therebetween generally around the central axis of the mounting body and with the edge of the collar having a plurality of surfaces for engaging the blade edges and camming them into different angles of external or outward extension relative to the mounting body. This permits the hunter to quickly adjust the blade extension immediately prior to shooting the arrow with the blade extension being selected as a function of the shot available.

An object of the present invention is to provide a novel and improved expandible arrowhead which exhibits minimal outward extension during flight but maximum outward extension upon impacting the target.

Another object of the present invention is to provide a novel and improved expandible arrowhead which uses minimal, lightweight components which can be easily replaced or assembled in the field while providing an assembly which has maximum structural strength as required for large game hunting.

A further object of the present invention is to provide a novel and improved expandible arrowhead which utilizes minimum components in an assembly which allows reliable long term usage.

Yet another object of this invention is to provide a novel and improved expandible arrowhead which has the cutting blades arranged for retracted orientation during flight but expanded orientation upon impact with a target while accommodating withdrawal so as to minimize further injury to the target during such withdrawal.

A still further object of the present invention is to provide a novel and improved expandible arrowhead which allows preselection of the angular orientation of outwardly extendable blades prior to the use of the arrow with optimum blade camming strength.

Yet another object of this invention is to provide a novel and improved expandible arrowhead which uses elements that are easily replaced in the field with these elements being replaceable separately or with the entire arrowhead being replaceable.

The foregoing and other objects, features and applications of the present invention will be more readily apparent in view of the following detailed description of various exemplary preferred embodiments.

DETAILED DESCRIPTION OF THE PREFERRED EMBODIMENTS

The preferred embodiments are shown with either rearwardly retracted cutting blades as in the embodiment of FIGS. 1–4 or with forwardly retracted blades as in FIGS. 11–15. However, it will be readily recognized that various elements and features can be used in either or both versions. A primary objective is to achieve an exceptionally large cutting diameter upon impact with a target but with minimial diameter in the retracted position to avoid degradation of the in-flight stability for the entire arrow assembly. The blades open immediately upon initial impact with the target. As the cutting diameter is increased through the extended blades, the effectiveness of the arrowhead is increased and the humane result is obtained by increasing the probability of immediate kill of a game animal or at least generation of a sufficient blood trail from external bleeding to allow tracking and finishing of the game animal. The arrowhead has a relatively small [typically less than one inch] in-flight diameter and is accordingly stable. As is known, increasing of the in-flight blade diameter decreases flight stability by causing the arrow to exhibit an increased tendency toward planing, wobbling and sensitivity to wind.

The most effective expanding broad head is one which opens upon entering the skin of a game animal creating profuse external bleeding for tracking instead of extensive internal hemorrhaging which does not facilitate tracking but is likely to be fatal to the animal. Few large animals can be dropped immediately and a relatively low percentage of the total number of animals struck with conventional broad heads have actually ever been recovered by the hunter.

Figure 1:
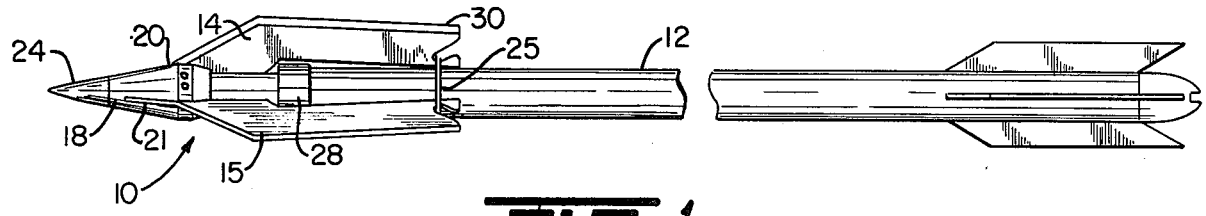
FIG. 1 is a partially broken side plan view illustrating an arrow with an expandible arrowhead in accordance with one embodiment of this invention with the cutting blades retained in their in-flight orientation.
Figure 3:
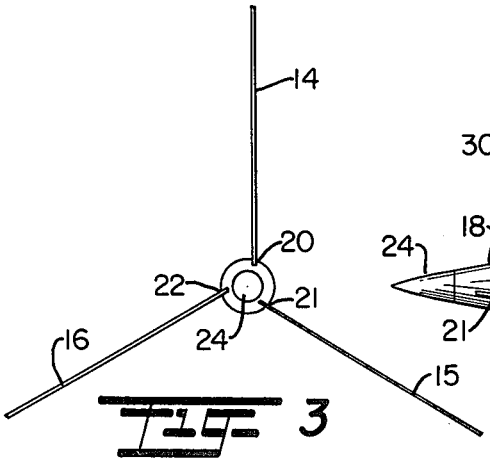
FIG. 3 is a front plan view of the arrowhead in accordance with FIG. 2.
Figure 2:
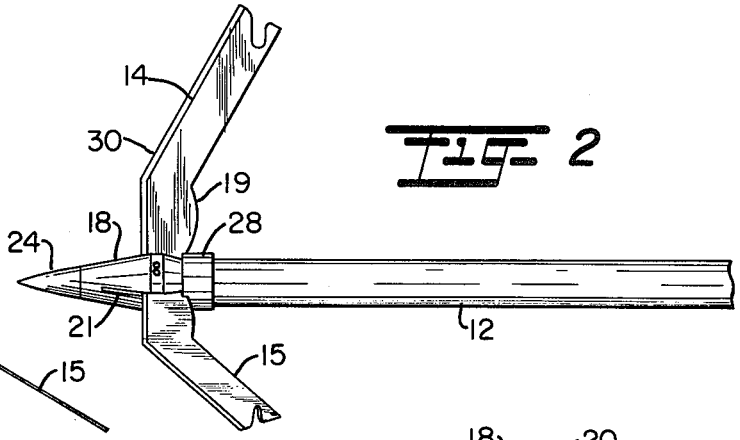
FIG. 2 is a partially broken side plan view of the FIG. 1 embodiment but with the cutting blades illustrated in maximum extended position.

FIG. 1 illustrates an expandible arrowhead assembly 10 in accordance with one embodiment of the present invention with assembly 10 being attached at the outer end of a conventional arrow shaft 12. The exemplary assemblies of FIGS. 1–4 include three cutting blades 14, 15 and 16. Blades 14–16 are pivotally mounted within elongated body 18 in respective arcuate slots 20, 21 and 22. Preferably a nose cone 24 with a piercing tip is removably attached by glue, threads, pressfit, etc., to the forward end of elongated body 18.

The tip or point 24 is subjected to the full impact upon striking a target and, since it is the initial penetrating element, its shape and composition is of some significance. Preferably, tip 24 is heat treated and tempered steel to resist deformation yet soft enough to prevent shattering on impact. A bullet-type cone 24 with a needle sharp point is generally ideal because of its ability to withstand high shock without bending or breaking even upon striking a rock. The needle point can be re-sharpened or simply replaced in the field. In addition, the cone shape deflects around bones of the target animal unless struck dead center and continues driving into the body. The broad head in accordance with this invention is not destroyed on striking a hard object.

Figure 4:
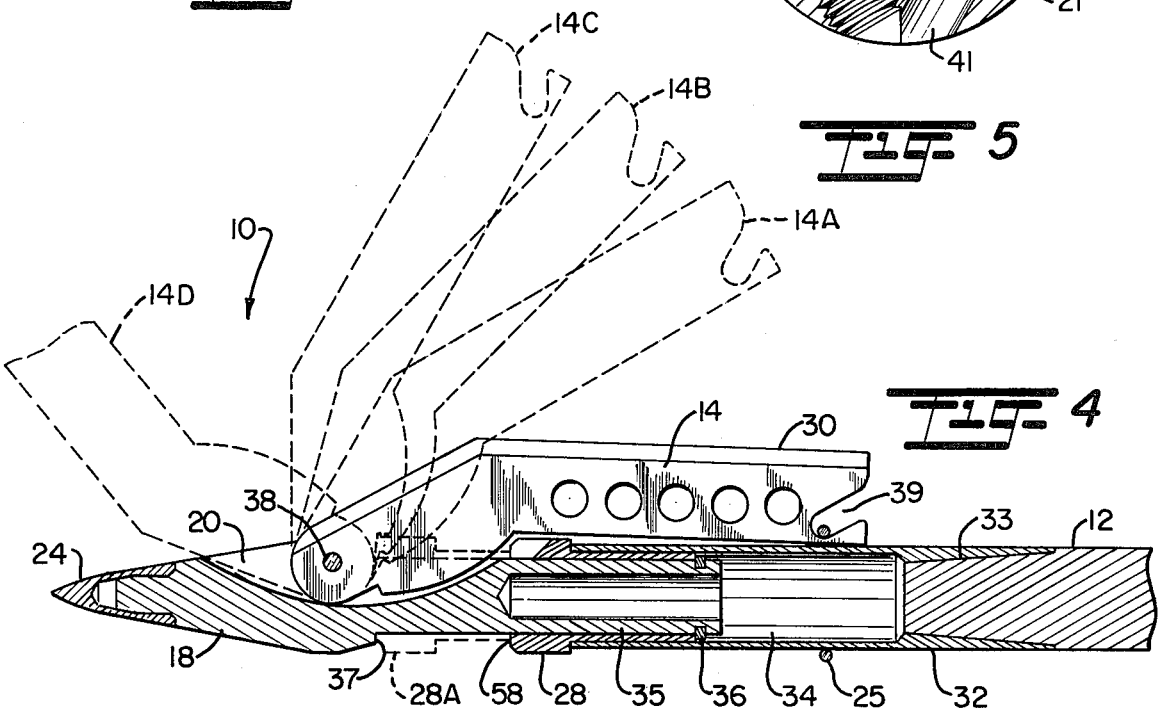
FIG. 4 is a partially broken and sectioned side view of the arrowhead shown in FIG. 1 illustrating the selectable blade camming feature and one form of arrow shaft attachment adapter.

Blades 14–16 as shown in FIG. 1 and FIG. 4 are held in the retracted position by resilient band 25 which can be an elastic band, frangible tape or the like. Thus, the retracted orientation shown in FIG. 1 will be maintained from the time that the arrow 12 is released from the bow and throughout the flight until nose cone 24 initially impacts the target. At that point, nose cone 24 and body 18 are forced rearwardly with body 18 telescopically moving within collar 28 thereby forcing blades 14–16 into the outwardly extended position shown in FIGS. 2 and 3. Each blade has a sharp cutting leading edge such as edge 30 for blade 14. Sharp cutting edges are vitally important to the effectiveness of a broad head when used for hunting large game because an arrow does not have the additional killing effect from shock and impact a high speed bullet produces. Internal organs and veins or arteries of such animals are relatively tough and elastic and can be pushed aside by dull edges. Blade edges become dull from contact when carried in some quivers and even from brushing against limbs, grass, etc., when carried in the bow. They must also be resharpened after a miss in the field which consumes valuable time. Further, hand sharpening is difficult and the ultrasharp machine-produced edges of replacement blades are almost impossible to duplicate in the field. By the present invention, many replacement-type blades can be carried in the field and carried more safely as in protective dispensers than is possible with fixed blade broad heads or expandible broad heads using intricate control mechanisms. Broad heads in accordance with the present invention are well adapted for quick replacement of the blades in the field simply by loosening the blade pivot screw or retaining pin. The blade shape, thickness, size and angle provide maximum penetration and effective cutting with adequate strength but minimum weight.

FIG. 4 particularly illustrates the camming action of sleeve 28 in conjunction with telescoping body 18 so as to effect selectable blade extension angles. In addition, FIG. 4 illustrates one form of adapter 32 for attachment to the end of a solid (usually wooden) arrow shaft 12 which terminates in a tapered configuration. Thus adapter 32 is formed with an internal tapered chamber 33 in which the end of shaft 12 can be glued or otherwise secured. The opposite end of adapter 32 has camming collar 28 bonded therein as shown in FIG. 4. Body 18 includes a rearwardly extending piston member 35 which telescopically extends into the inner chamber 34 of adapter 32 and is retained therein by C-ring 36. The blades 14–16 are pivotally retained within appropriate slots by a pin such as pin 38 which mounts blade 14 in slot 20. The entire assembly assumes the orientation shown in solid lines in FIG. 4 with elastic or frangible band 25 in place in surrounding relation through the angled rear notches such as 39 in the blades.

The retracted orientation of the blades in FIGS. 1 and 4 is thus maintained throughout flight of the arrow until tip 24 initially impacts the target. This causes piston portion 35 of mounting body or housing 18 to coaxially and telescopically move within adapter 32 into chamber 34 thereof until it engages collar 28 in the relationship shown in phantom at 28A. As will be appreciated from the subsequent description, blade 14 is cammed outwardly into an extended position such as one of positions 14A–14C shown in phantom in FIG. 4 which will be its final position when the blade housing body 18 and collar 28 are fully engaged as at 28A. By utilizing an arcuate slot 20, blade 14 can likewise be pivoted forwardly into the 14D position for withdrawal. Animals will remove arrows with which they are struck if they succeed in escaping by pulling with their teeth or otherwise working the arrow outwardly. Thus, an animal struck with the arrowhead in accordance with this invention can more easily free itself of that arrow since pulling on the shaft will cause the blades 14–16 to pivot into their reduced extension position as at 14D in FIG. 4 and retrace its entry path in a more facile manner thereby reducing the prospect of further injury to the animal.

Figure 5:
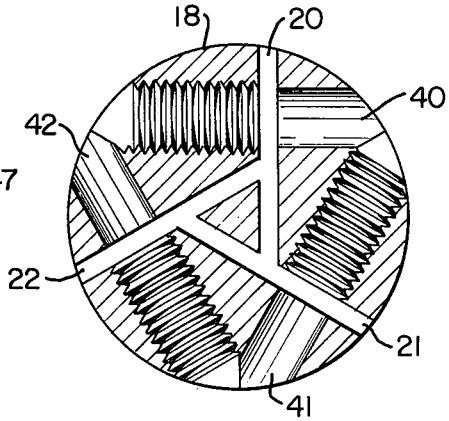
FIG. 5 is a section view taken transversely through a typical blade mounting body for a three blade arrangement.

The offset mounting feature of the present invention for retaining the blades within slots 20–22 is best seen in the cross-sectional view of FIG. 5. Three threaded bores 40–42 extend perpendicularly to slots 20–22, respectively, with the threaded portions thereof extending to one side of the associated slot and open passageways continuing therethrough. Thus, each blade can be retained in place by inserting a set screw into the appropriate threaded passage 40–42 as with a Allen socket-type screw. Note that the depth of slots 20–22 is significantly increased as compared to positioning these slots on direct radial lines from the central axis of mounting body 18. That is, by utilizing the offset location of slots 20–22 relative to the central axis of body 18, the depth of the slots is increased thereby insuring that a greater radius of the attachment end for the blades can be accommodated thus increasing its strength.

Figure 6:
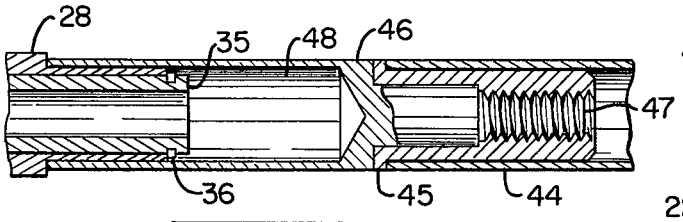
FIG. 6 is a partially broken and sectioned view of another form of adapter for attaching arrowheads in accordance with this invention to an arrow shaft.

FIG. 6 shows another form of adapter for attaching arrowhead assembly 10 to an arrow shaft wherein like elements are given like reference numerals as compared to FIG. 4. In FIG. 6, a hollow arrow shaft 44 which might typically be a conventional aluminum or fiberglass arrow shaft has adapter 45 glued, bonded or otherwise secured therein. Adapter 45 is internally threaded to receive an additional adapter collar 46 which is externally threaded on end portion 47 thereof for attachment within adapter 45. However, adapter element 46 includes an internal chamber 48 in which camming collar 28 is glued or otherwise bonded. Further, the piston member 35 of housing body 18 is retained within chamber 48 by C-ring 36 substantially as with the tapered adapter shown in FIG. 4. The adapter assembly of FIG. 6 is particularly advantageous in that the entire arrowhead assembly 10 can be removed along with adapter element 46 if desired. However, various other arrangements and modifications of such adapters for attachment of assembly 10 as an extension in alignment with the length of the arrow shaft will be readily apparent. For instance, adapter elements 45 and 46 could clearly be combined into a single unit for bonding or frictional attachment within arrow shaft 44. Furthermore, collar 28 can be adapted to be attached directly in the end of a hollow arrow shaft with housing 18 in place within collar 28. Thus piston member 35 would then move coaxially into the interior of the arrow shaft upon impact with the target. Such an arrangement enjoys the advantage of minimum total head weight thereby establishing a flatter trajectory in use. Adapters such as those shown are only required where solid shaft arrows are used or where it is desirable to quickly remove or attach the entire head assembly.

Figure 7:
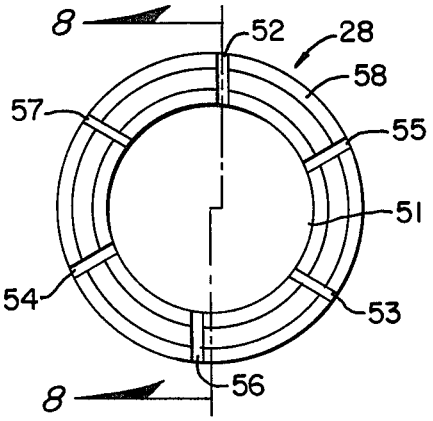
FIG. 7 is a front plan view of a typical camming collar.
Figure 8:
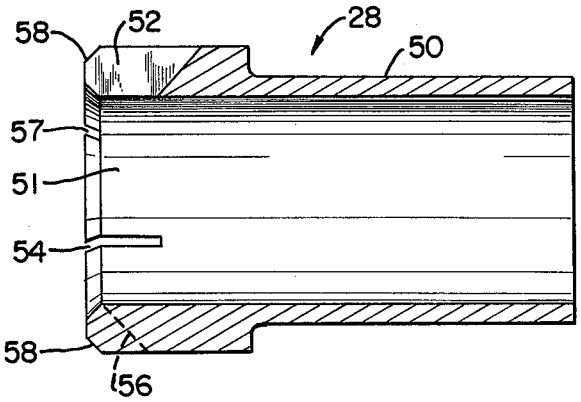
FIG. 8 is an offset section view taken along lines 8—8 of FIG. 7.

FIG. 7 illustrates an end plan view of multiple cam surface collar 28 with FIG. 8 illustrating a section view taken along offset section line 8—8 of FIG. 7. Collar 28 has a reduced shoulder portion 50 at the rear thereof for attachment within the open end of a hollow arrow shaft or of the particular adapter employed. Further, collar 28 has a hollow interior 51 for rotatably receiving the rear element of the mounting body and further for receiving in a telescopic manner the rear portion when an arrowhead in accordance with the FIGS. 1–4 embodiment is used. Collar 28 likewise includes two sets of slots extending thereinto, namely, slots 52, 53 and 54 as one set with slots 55, 56 and 57 providing the other set. These slot sets are radially spaced around the central axis of collar 28 with the same spacing as blades 14–16 so that they can be pivotally aligned rearwardly of those blades. Furthermore, collar 28 includes a chamfered edge 58 extending circumferentially therearound. Accordingly, blade mounting body 18 can be rotated within collar 28 until blades 14–16 align with either slot set 52–54, slot set 55–57 or neither of these slot sets in which event it is effectively aligned with chamfered edge 58. As can be best seen from FIG. 8, the rear faces of these slot sets effectively provide a progression of slot depths with slots 52–54 being of the greatest depth, slots 55–57 being next shallowest and chamfered edge 58 effectively being the third edge.

Figure 16:
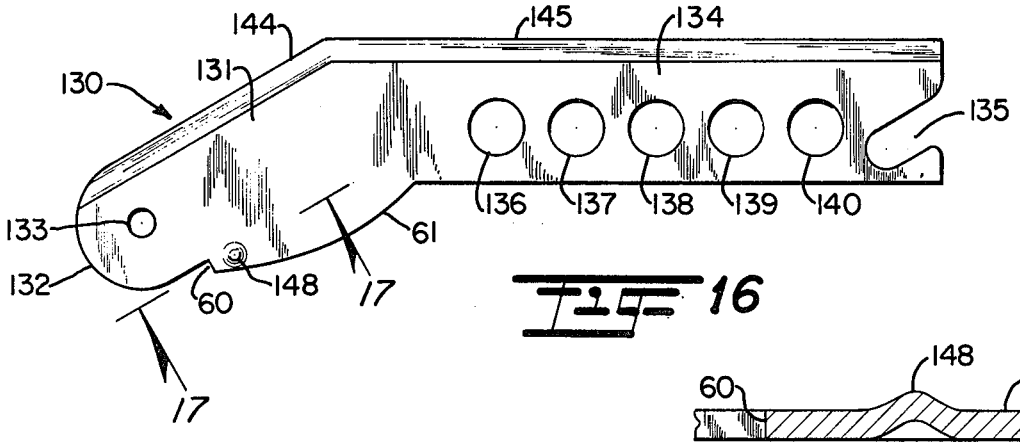
FIG. 16 is a side plan view of a typical cutting blade and illustrating a dimpled type of retainer.

With the deepest slot set 52–54 aligned with blades 14–16, a full coaxial or telescoping movement of mounting body 18 relative to collar 28 will result in the shallowest outwardly extending angle for these blades as is shown in phantom in 14A in FIG. 4. With slot set 55–57 so aligned, the blades will assume an intermediate extended position as shown at 14B when body 18 is fully forced axially into collar 28 whereas position 14C of FIG. 4 will be assumed when none of the slot sets are aligned so that the blades are resting on the chamfered edge 58. By configuring the blades as illustrated in the full side views of FIGS. 1, 2, 4 and 16, the blades are fully locked and prevented from retracting when in the full open position. Sleeve or collar 28 slides into the rearward notch as shown at 60 in FIGS. 16 and 17 and the point of this notch presses against the digs into the top of the sleeve 28 as a counteracting force is exerted against the blade cutting edge. This feature further prevents the blades from collapsing as the forward momentum of the arrow shaft decreases. The radius edge of the blades as shown at 19 in FIG. 2 and 61 in FIG. 16 provides a relatively constant wedging angle against the camming sleeve as the blade is cammed in the outward extending direction by that sleeve. The radius edge is preferably configured to slidingly interface with the 45° cam face or faces of the sleeve 28. Thus the wedging force occurs at the face of the radius edge at a perpendicular to the approximately 45° cam face of the sleeve thereby forming a rotary force couple around the pivot pin. The maximum wedging force occurs when the blade cutting edge is at a relatively shallow angle of extension (i.e.: 30°) as the cam wedge angle is lowest at this blade position and the wedge force location has the greatest lever arm advantage relative to the axis of rotation of the blade.

Figure 21:
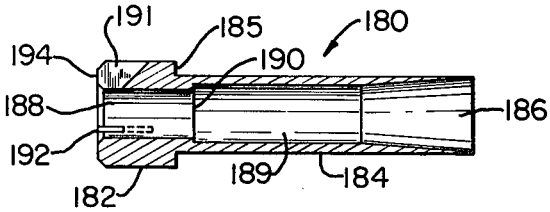
FIG. 21 is a side section view of another form of camming collar which does not require an adapter.

A universal adapter 180 having the multiple shouldered camming collar formed integrally therewith is shown in FIG. 21. Adapter 180 includes a forward collar 182 at the forward end with a rear portion 184 extending from radial shoulder 185. Rear portion 184 has an outside diameter for fitting within the open end of a hollow arrow shaft and further terminates in a tapered conical opening 186 adapted for internally receiving and securing the tapered end of a solid arrow shaft. The collar 182 has a bore 188 opening into internal cavity 189 for slidably receiving the piston end of a blade mounting body. This blade mounting body would be substantially as described before except that it would include a self-contained retaining means at the end terminating within cavity 189 for engaging inner radial surface 190. For instance, this retention function could be provided by a resilient spring biased ball or C-ring and groove type of snap-in retainer, a threaded screw-in type arrangement, a split leaf spring configuration with radially extended lips on the end for forming the piston barrel, or any of a wide variety of known devices. Although the retention means could be omitted entirely, this is not desirable for game hunting purposes since the arrowhead would become detached when the shaft is withdrawn from the animal or target.

Note that camming collar 182 is similar to the collar discussed previously except that it includes only one set of camming slots. That is, assuming a three blade configuration is used, three slots are arrayed around the collar with the same radial spacing as the blades, only slots 191 and 192 being visible in FIG. 21. Between this slot set which is alignable with the blades and chamfered end 194, two blade extension positions are selectable prior to use of the assembled arrow.

Figure 22:
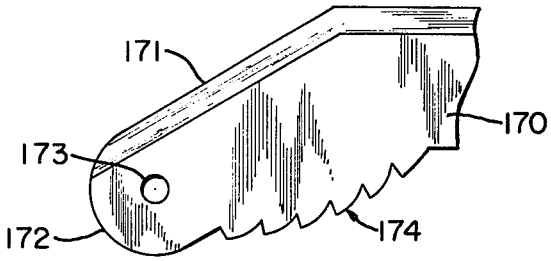
FIG. 22 illustrates a potential modification of a blade to include multiple locking notches.

Blades configured as shown in FIGS. 4 and 16 do not lock on the outward extension positions except for the fully extended positions of 14A and 14B, the blades tend to retract or close in the presence of an extreme counteracting force from the encountering of a particularly obstinate element such as the bone of a game animal by the blade cutting edge. This feature assures deeper penetration with the shallower blade angles. The blades tend to re-open after passing the bone and encountering softer internal organs. However, the present invention can be easily modified to lock the blades in any extended position and an example for effecting this result is illustrated in broken view in FIG. 22. More particularly, blade 170 has a cutting edge 171, a semi-circular mounting end 172 and pivotal mounting bore 173 essentially the same as described. However, the curved camming edge 174 is formed in a somewhat serrated configuration with a plurality of spaced locking notches. As a result, a ratchet type of action is provided as the blade is cammed outwardly thereby establishing a locked relation for the blade for any extended position.

Figure 9:
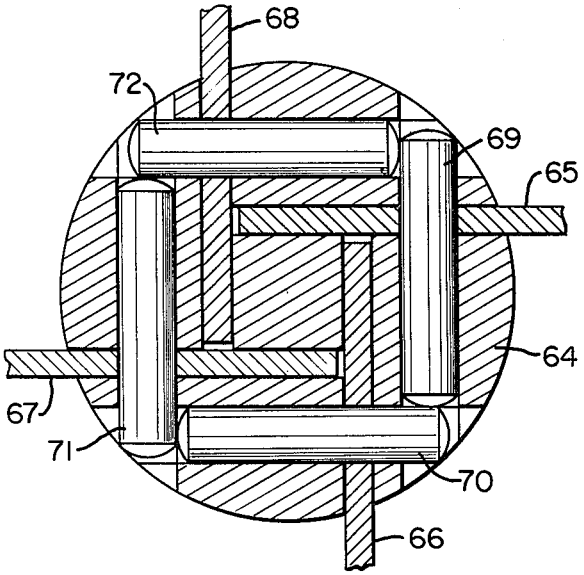
FIG. 9 is a transverse section view of a blade mounting arrangement for accommodating four blades.
Figure 10:
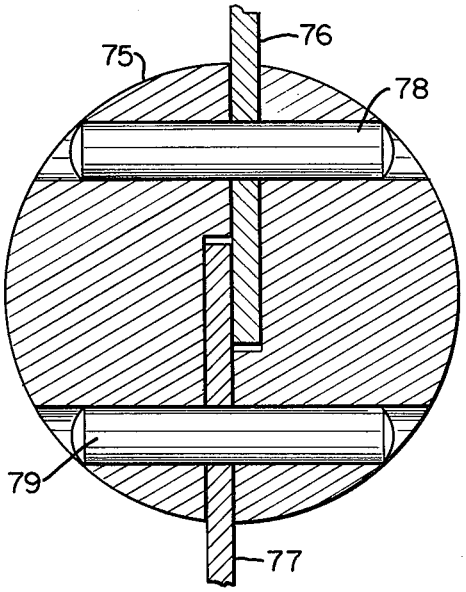
FIG. 10 is a transverse section view of a blade mounting arrangement for two blades.

It will likewise be recognized that greater or lesser numbers of blades can be employed in accordance with the present invention. For instance, FIG. 9 illustrates a partially sectioned view taken transversely through an elongated body 64 which has four offset slots for receiving blades 65–68 each of which is retained in place by a snugly fitting pin 69–72, respectively. Similarly, FIG. 10 illustrates a cross-section of a blade mounting body 75 which retains blades 76 and 77 within overlapped slot arrangement by retaining pins or set screws 78 and 79. The slots and blades need not be located parallel to a plane perpendicular through the central axis of the body as illustrated in FIGS. 5, 9 and 10 but may be canted at an angle to accomplish the overlapping interrelationship.

Figure 20:
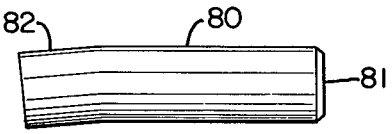
FIG. 20 illustrates a side view of a retaining pin useful in place of set screw blade retainers.

A deformed pin which might typically be employed to retain the blades in place within the body is illustrated in FIG. 20. The cylindrical pin 80 is formed with a chamfered or radius edged end face 81 and has the rear portion 82 for approximately one-fourth of the length of the body bent slightly out of alignment with the central axis of body 80. The amount of such deformation for end portion 82 is typically in the range of 0.004–0.006 so that, with a diametric clearance of 0.002 between the sidewalls and the mounting hole, a force fit will be established. In use, pin 80 is forced through an unthreaded bore transverse to the blade mounting slot and likewise through the pivotal mounting hole in the radial end of the blade to be attached. As the last quarter or end portion 82 of the pin enters the mounting hole, it will force a wedging relation with the side walls of the mounting hole thereby retaining the pin in place yet allowing free rotational movement of the blade within the radial mounting slot. This type of pin can be installed and removed with ease and can be reused indefinitely since the pin assumes its deformed relation after removal.

Figure 11:
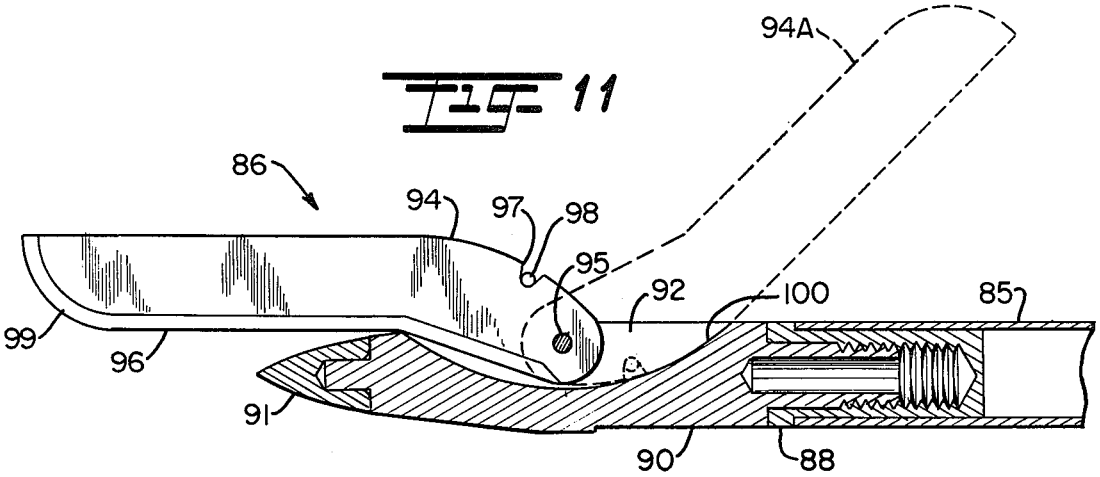
FIG. 11 is a partially broken and sectioned view of another embodiment in accordance with the present invention.

FIG. 11 shows an alternate embodiment in accordance with the present invention wherein the tip of a hollow arrow shaft 85 is shown with assembly 86 attached thereto. In this exemplary illustration of the second embodiment, assembly 86 is attached to hollow arrow shaft 85 via an insert adapter 88 which has a threaded interior which further receives the externally threaded portion of mounting body 90. That is, adapter 88 preferably is glued, bonded or otherwise secured within the end of arrow shaft 85 and the entire blade assembly 86 threaded thereinto for removable attachment. The blade mounting body 90 is similar to the FIG. 1 embodiment in that it has a detachable nose cone 91 thereon and includes a radial arcuate slot 92 for pivotally retaining blades such as 94 around pin, set screw or the like 95.

Mounting housing 90 differs from the FIG. 1 embodiment in that it is fixed relative to adapter 88 and the blades such as 94 are arranged for forwardly extended but retracted position as shown in FIG. 11 with the cutting edge 96 facing toward the central axis of body 90. The blades 94 for the FIG. 11 embodiment are oriented with the bend therein oppositely directed from the FIG. 1 embodiment blades and are retained in their retracted in-flight orientation shown in solid lines in FIG. 11 by an inwardly directed notch or slot 97 near the pivotal mounting hole thereof with an elastic or frangible band 98 being received by this notch to hold the blades in this orientation. The leading edge 99 of blade 94 is outwardly oriented as shown so that, upon initial impact with the target, an outwardly pivoting force will be applied to blade 94 until it assumes the position shown in phantom at 94A. The elastic band 98 will then have been either broken or pivoted over center relative to mounting pin 95 so as to release the inwardly retaining force thereof and allow the rear arcuate surface 100 of blade 94 and notch 92 to retain the blade in its outwardly extended position shown at 94A. Thus blade 94 will be held at its desired outwardly extended position upon impact but, because of the radially formed arcuate slot 92 and pivot pin attachment 95, can be rotated back into the forwardly directed position during withdrawal of the arrow from the target thereby exhibiting minimal outward extension during such withdrawal. Note further that, even though the embodiment shown in FIG. 11 does not use any telescoping members as with the FIG. 1 embodiment, an outward blade extension controlling collar similar to that shown in FIGS. 6 and 7 could be included as an element with adapter 88 so as to allow preselection of the outward extending angle prior to use of the arrow.

Figure 12:
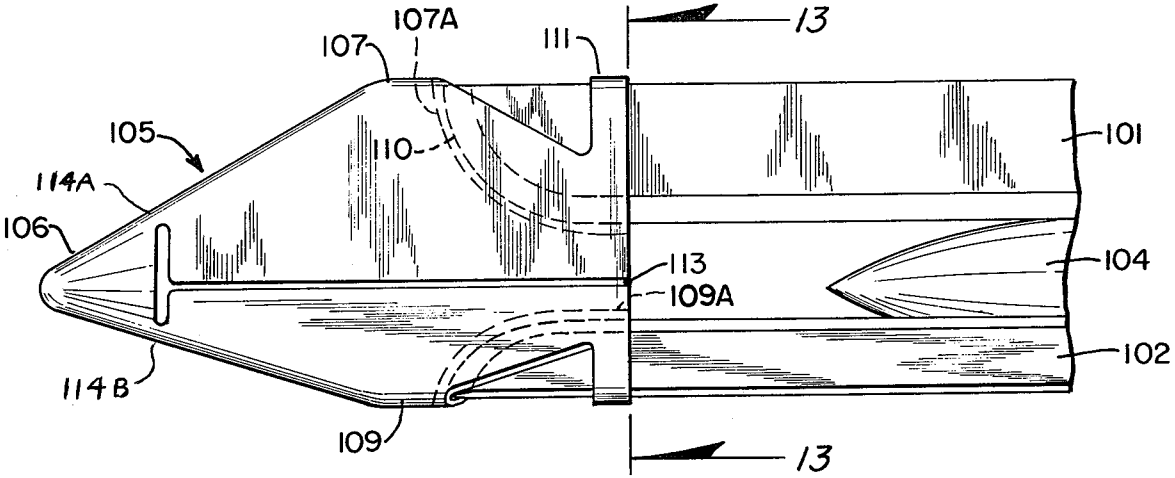
FIG. 12 is a side view of a retaining cap for a forward blade oriented version of the present invention.
Figure 13:
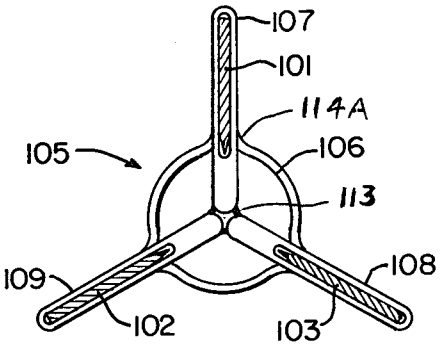
FIG. 13 is a view taken along lines 13—13 of FIG. 12.

Another means of retaining the forwardly pivoted blades of the second embodiment is shown in FIG. 12 and in FIG. 13 taken along line 13—13 of FIG. 12. In this example, it is assumed that three blades 101, 102 and 103 are employed and pivotally mounted for forward and inward retraction with a slotted assembly similar to FIG. 11, nose cone 104 thereof being shown in FIG. 12. However, a retaining cap assembly 105 holds blades 101–103 in place via a unitary cap 106 and rearwardly extending envelope portions 107, 108 and 109. Each of the rearwardly extending blade envelope portions 107–109 includes an internal face 107A–109A (only faces 107A and 109A being visible in FIG. 12) which engages the leading edge such as 110 of the associated blade and a rearward shoulder 111 which defines an open slot so that the proper insertion of the blade within the envelope retainer can be determined yet the blade securely retained. Each shoulder can be frangible so as to sever upon impact of nose cone 106 with the target and in response to faces 107A–109A outwardly forcing blades 101–103 or, alternatively, a groove 112 can be incorporated through body assembly 105 or incorporated as a frangible score line therein. Further, a relatively weak bridge or weld area 113 can be included to release in response to outward pressure on the shoulders as at 111. Thus, the nose cap assembly 105 can be formed of inexpensive plastic materials as a throwaway item after usage. This cap also serves as a protective safety cover for the blades.

Figure 14:
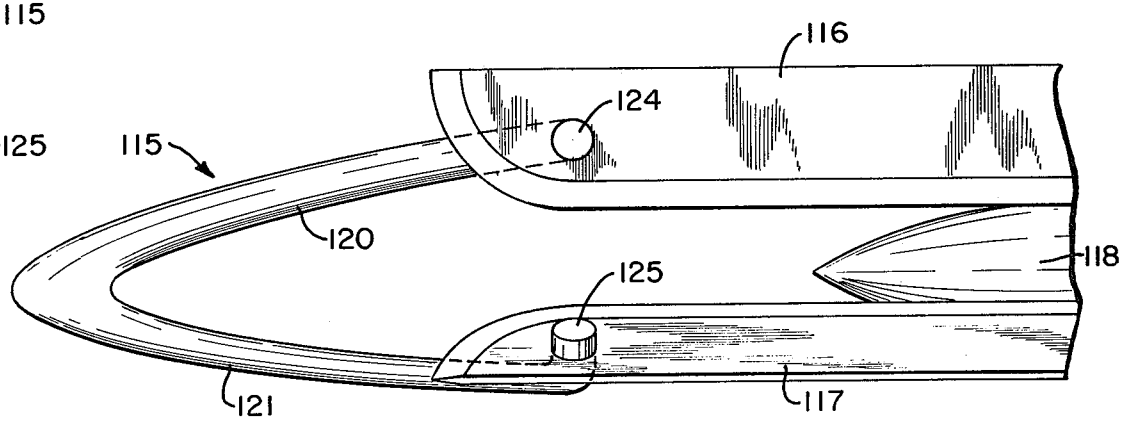
FIG. 14 shows yet another arrangement for adapting the present invention for retaining the pivotally mounted blades in a forward in-flight orientation.
Figure 15:
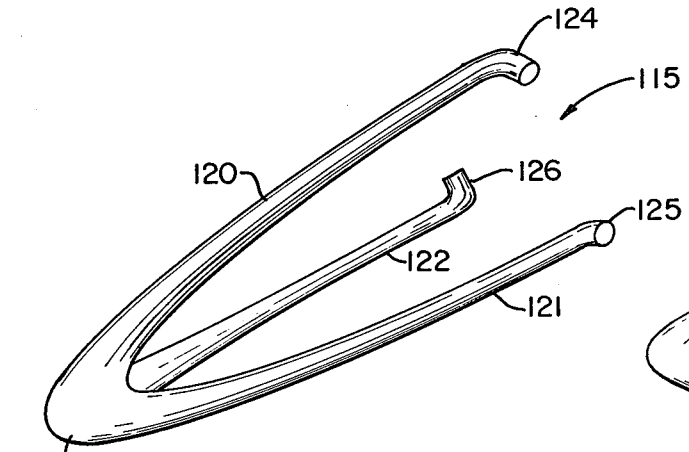
FIG. 15 is a perspective view of the retaining nose assembly of FIG. 14.

Yet another blade retaining cap 115 is shown in FIGS. 14 and 15. Blades 116 and 117 are retained in their forward pivoted position by an assembly similar to FIG. 11, nose cone 118 thereof being visible in FIG. 14. However, assembly 115 includes three rearwardly extending prongs 120, 121 and 122 each of which has an outwardly extending nub 124, 125 and 126 adapted to fit within a receiving hole in the associated blade. Thus, as conical tip 128 impacts the target, legs 120–122 are spread outwardly on impact and push the blades outwardly. Assembly 115 can be arranged to move rearwardly until it engages nose cone 118 at which point the blades 116–118 are fully outwardly extended or nubs 124–126 can be arranged to break at the bases thereof on initial impact thus releasing the blades for rearward pivoting.

A typical blade useful in conjunction with this invention is shown in somewhat expanded view in FIG. 16 which likewise includes yet another arrangement for retaining the blade in its retracted position. Blade 130 includes a first end portion 131 which terminates in a radial end 132 with a bore 133 therethrough for receiving a set screw, pin or the like. The underside of end portion 131 is formed with an arcuate or radial segment 61 as mentioned previously. The rear portion 134 extends at an angle relative to forward portion 131 and includes end notch 135 to receive an elastic or frangible retaining member and a plurality of bores 136–140 primarily intended for lightening the weight of the blade. When used for a FIG. 1 type of embodiment, leading edges 144 and 145 will have a cutting edge formed thereon.

Figure 17:
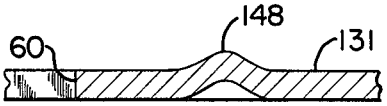
FIG. 17 is a side section view taken along line 17—17 of FIG. 16.

The particular exemplary blade shown in FIG. 16 further includes an outwardly extending nub or dimple 148 which is shown in section view in FIG. 17. Nub 148 is dimensioned so as to extend outwardly for a distance greater than the total clearance between the edge of the radial slots in the mounting body and the outer surfaces of the blade. That is, if the clearances between the outer surfaces of blade 130 and its associated mounting slot in a housing or body is 0.002 inches, nub 148 might typically be dimensioned to extend outwardly from the upper surface of blade 130 by 0.004–0.006 inches. This frictional engagement between the slot wall and the blade nub is sufficient to retain the blade in its retracted position during flight but insufficient to prevent outward pivoting in response to impact with the target. Note that the rear elastic or frangible band-receiving slot 135 might still be included in the blade in the event that continued usage of nub 148 results in its loss of sufficient retention friction to insure retraction of the blades so that the elastic or frangible band can be later used. Note also that the restraining nub concept can likewise be incorporated in the forwardly retained blade embodiments of this invention.

Figure 18:
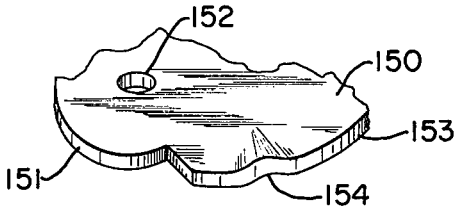
FIG. 18 is a partially broken perspective view illustrating an edge ripple retainer arrangement for a blade.

Still another arrangement for implementing the equivalent function of nub 148 is shown in the broken view of FIG. 18 showing a corner of a blade 150 in proximity to its curved end portion 151 and pivotal mounting bore 152. Instead of a dimple as in FIGS. 16 and 17, the edge 153 has a ripple or ridge 154 formed therein to effectively provide the same frictional interference retention of nub 148.

Figure 19:
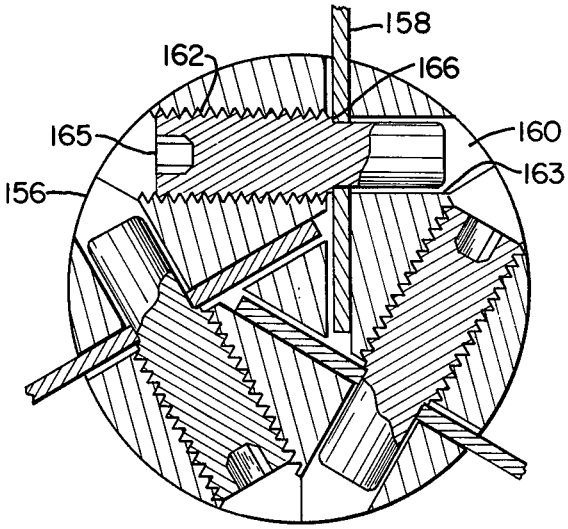
FIG. 19 is a section view illustrating a set screw friction shoulder retaining arrangement.

FIG. 19 illustrates yet another arrangement for frictionally retaining a blade in position during flight. As with the prior embodiments, body 156 includes a plurality of slots for retaining blades such as 158 shown in broken section view and a plurality of bores such as 160 extending therethrough with one end 162 being threaded and the opposite end 163 being open. A set screw 165 is adapted via threading on one end to engage threads 162 with these threads terminating in a shoulder 166 which abuts the edge of the blade 158 around the pivotal mounting hole therethrough. It is assumed in this example that the section view of FIG. 19 is taken looking toward the nose cone of a mounting body similar to the FIG. 1 embodiment and that the threads 162 are righthand threads. Set screw 165 is threaded into bore 160 until it firmly engages the surface of blade 158 at interfacing shoulder 166 thereby providing frictional retention of blade 158 in the retracted position shown in FIG. 1. Upon impact of the nose cone of the assembly with the target, a force will be applied due to the camming collar action as well as the inertial qualities of the blade 158 in an offset direction around the central axis of set screw 165 and in a loosening direction relative to the righthand threads of set screw 165. Thus, after about 10° rotation of blade 158, set screw 165 will be sufficiently loosened to release its frictional engagement with interface 166 so that blade 158 is effectively free to pivot to its outwardly extended position or to its fully forward position as when the arrow is withdrawn.

Note that the easy disassembly of the present invention not only makes possible the replacement of component parts in the field but further allows conversion of the arrowhead to a small game arrow by simply removing the blades. Further, removal of the blades can be effected for target practice although preferably some additional weight to compensate for the absence of the blades should be used in such circumstances. This additional weight can take the form of a steel ring or insert which exactly replaces the blade weight but which fits within the space between the front of the camming collar and the shoulder of the blade mounting body. That is, this steel ring would fit in FIG. 4 between front edge 58 of collar 28 and the circular shoulder 37 of body 18. This not only replaces the weight of the absent blades but likewise holds body 18 and tip 24 in the forward position thereby simulating a conventional fixed tip arrowhead for target practice or small game usage. The blade aerodynamic flight characteristics can be simulated by casting an arrowhead having the same external configuration and same weight as the present arrowhead but with no moving members. Other variations for practicing or small game use will be readily apparent.

The weight of a broad head is a significant factor since it effects flight trajectory and stability. The present invention is particularly advantageous in that it provides minimum weight with adequate strength thereby allowing a flat trajectory to improve accuracy especially as range increases. Judging arrow drop at various distances is the major aiming consideration in bow hunting and lighter weight broad heads as are now possible with the present invention are therefore highly desirable. The mounting body and adapters of the present invention can be fabricated from high strength, lightweight aluminum alloys such as #2024 or #7075/60k–80k psi tensile strength. The present invention can be directly attached to a hollow arrow shaft without adapters if the user so desires. Further, by using 0.018–0.020 tool steel for the blades and with a three blade arrangement similar to that shown in FIG. 1 and dimensioned as discussed below, the broad head in accordance with the present invention including a hardened steel tip weighs only 134 grains which is particularly remarkable when considering that it will yield a 3.62 inch cutting diameter and withstand tremendous impact.

In a typical configuration, the blades are formed of alloy or high carbon steel which is heat treated and tempered to 50–55 Rockwell "C" scale which also applies to the tip, retaining C-ring and pivot pins or screws. The mounting body such as 18 of FIG. 4 is typically 2.090 inches from front to rear edge and with a diameter of 0.375 inches through a center line at the mounting holes as for pins 38, this center line being 1.360 inches from the rear. The diameter of piston member 35 from radial shoulder 37 to the rear end for a distance of 1.230 inches is typically 0.2499 inches which is hollowed out by counterboring with a #27 drill for approximately 0.700 inches. Radial slot 20 is cut on a 0.875 inch radius from a center point 0.062 inches rearwardly of the vertical center line through the mounting holes for the blade pins or set screws. The pin or set screw holes are typically formed with #53 drills and positioned radially inwardly from the upper surface by 0.080 inches. The maximum slot depth for slot 20 relative to the maximum periphery (i.e.: at the pivot center line) is 0.220 inches.

As seen in FIG. 16, a typical blade from a center line through bore 133 to the end of end portion 134 [i.e.: where slot 135 is formed] is 1.750 inches and the curved end 132 is typically formed as a semicircle of a 0.130 inch radius. Curved edge 61 is typically formed on a 0.500 inch radius taken from a point defined by the line of upper edge 145 and a vertical line 0.205 inches rearwardly from the center line through bore 133. Bore 133 is typically a maximum diameter of 0.061 inches. Forward portion 131 joins rear portion 134 [i.e.: the angle defined by edges 144 and 145] at a 30° angle and rear portion 134 is typically 0.315 inches high. Holes 136–140 are typically 0.125 inches in diameter with 0.180 inches spacing between holes and the hole 140 being 0.285 inches from the rear face of portion 134 and 0.125 inches above the lower edge. Notch 135 extends inwardly at an angle of about 30° and is typically 0.090 inches wide and extends inwardly until centered about 0.080 inches above the bottom edge. Notch 60 is 0.085 inches maximum rearwardly from the center line through bore 133.

Sleeve 28 as seen in FIGS. 7 and 8 is typically 0.700 inches in total length with the rear shoulder portion being 0.500 inches. Rear portion 50 is preferably formed with an outside diameter to fit the I.D. of various hollow shafts but typically is 0.2965 inches in outside diameter with the internal bore 51 being reamed to 0.250 inches diameter. The deeper slots such as 52 extends from the end face to a point 0.150 inches and are sloped at approximately 45° whereas the shallower notches such as 56 are spaced from the end face by 0.075 inches although likewise sloped at 45°. The end face as at 58 is double chamfered at 0.020 × 45° and the outside diameter at the end face 58 is 0.375 inches. For bonding and/or force fitting collar 28 into an adapter or end of an arrow shaft, the outer surface of rear portion 50 can be grooved with eight to twelve grooves at 0.002–0.004 inches depth as for glue retention. The slots 52–57 are typically formed with a 0.020 × 1.750 diameter cutter. The nose cone 24 for this assembly is 0.400 inches in length formed with sides on a 1.25 inch radius and terminating in the rear end portion at 0.200 inches diameter with a 0.25 inch diameter bore thereinto for approximately 0.250 inches although tapered at approximately 15° for the outer half of this bore. With the blades forced into the deepest slots as at 52 in FIGS. 7 and 8, the blades dimensioned as mentioned above will have the outer portion thereof extended at a 30° angle for an outer extension diameter of 2.65 inches. When the blades are in the 0.075 slot such as 56 of collar 28, the outer portion of the blades will form a 45° angle relative to the central axis of the arrow shaft and body 18 thereby effecting a 3.25 inch diameter extension. Finally, with the locking notches of the blades resting on the outer chamfered edge 58 of collar 28, the cutting edge of the outer portion of the blade will be at a 60° angle thereby defining an outward extension cutting diameter of 3.62 inches.

In use, the blade mounting body is attached to the end of an arrow shaft as a lengthwise extension thereof. This attachment can be either direct to the arrow shaft or through an appropriate adapter. The body can be attached in advance or the attachment can be performed immediately prior to use in the field. Typically, the hunter might attach the mounting body without the blades contained therein so that the blades can be carried separately and in protection from any diminishing of the sharpness of the cutting edges thereof. Immediately prior to use, the blades can be inserted in the radial slots in the mounting body and secured by set screws, pins or the like. When using the FIG. 1 type embodiment, the blades are attached with the cutting edge outwardly facing from the body and pivoted into the rearward retracted position where they are either retained by friction means or by a frangible or elastic band as discussed above. The arrow is placed in a conventional bow and released at the target and will maintain its retracted blade orientation throughout its flight. Upon initial impact with the target, the blades will be released from their retaining or holding means and pivoted outwardly as they enter the target thus creating maximum cutting from the initial target entry and thoughout the movement within the target. The blades are securely retained in their outward extension position by the collar or the rear portion of the retaining slot but can be pivoted forwardly as the arrow is withdrawn to minimize outward extension during such withdrawal.

For the second embodiment usage, the blade pivotal mounting body might be typically attached as an axially aligned extension of a conventional arrow shaft considerably prior to use and the blades not mounted therein until immediately prior to use. Alternatively, the entire assembly with blades included might be attached well in advance of use particularly if the protective retaining cap is employed. The blades are attached with the cutting edges pivoted forwardly and into generally facing relation at which point a retaining means is engaged to hold them in that orientation. The arrow is shot by a conventional bow and, either through the frangible captype retainer or through the outwardly curved end portion of the blades, the blades are released from their holding device and allowed to pivot outwardly and rearwardly as they initially impact the target thus effecting maximum cutting immediately at the target surface and as the arrowhead continues into the target. The blades are held in their outwardly extending position by either the rear slot of the radial mounting arrangement or by a selectable collar similar to the rearward folding type embodiment. However, the blades are still free to pivot forwardly relative to the arrow shaft as it is withdrawn thus minimizing their extension during such withdrawal.

Although the present invention has been described with particularity relative to the foregoing detailed description of exemplary preferred embodiments, various modifications, changes, additions and applications other than those specifically mentioned herein will be readily apparent to those having normal skill in the art without departing from the spirit of this invention.

What is claimed is:

1. An arrowhead attachable to the end of an arrow shaft comprising:

an elongated body provided with at least one longitudinally extending slot in its external surface, means attaching said body to the end of the shaft for coaxial relative movement between said body and the shaft, at least one blade member having a free end portion and an opposite pivotal end portion with said end portions being joined lengthwise in an angularly displaced relation, said pivotal end portion being insertable in said body slot and including means pivotally securing said pivotal end portion to said body so that said blade is pivotal through an angle greater than 90° around an axis perpendicular to but in offset relation from the general plane of said free end portion, said blade being pivotal in a direction away from the axis of said elongated body between a normally retracted position wherein the length of said free end portion is substantially parallel to the length of said elongated body and an extended position in which the length of said free end portion forms an acute angle with respect to the length of said body and in the direction of the shaft, and means responsive to said coaxial relative movement for engaging an edge of said blade member pivotal end portion in offset relation to the central axis of said body so as to introduce a rotary force to said blade member outwardly from said body.

2. An arrowhead in accordance with claim 1 which includes means holding said blade against rotation around said pivotally securing means and in said normally retracted position such that the elongated edges of said blade are generally parallel to the length of said body, said holding means being responsive to axial force in the direction of the length of said body from impact with a target for releasing said blade for rotation about said pivotally securing means.

3. An arrowhead in accordance with claim 2 wherein said blade includes a notch opening thereinto, and said holding means is a yieldable band receivable by said notch for retaining said blade in said normally retracted position.

4. An arrowhead in accordance with claim 1 which includes a plurality of said blades each including a said pivotally securing means and a plurality of said slots having respective said blades pivotally secured therein, said slots being distributed around the external surface of said body with equal spacing therebetween.

5. An arrowhead in accordance with claim 4 wherein each said slot is offset from but parallel to a plane perpendicular to the central axis of said body.

6. An arrowhead in accordance with claim 1 wherein said coaxial relative movement responsive means includes a hollow collar attached as a peripheral extension of the arrow shaft, said body including a piston member slidably and telescopically movable within said collar, said collar engaging an edge of said blade during movement of said piston member into said collar for camming said blade into outward extending relation to said body.

7. An arrowhead in accordance with claim 6 wherein said collar and said body are mounted for rotary movement therebetween around the central axis of said body, the edge of said collar opposite the arrow shaft having a plurality of surfaces for engaging said blade edge and camming said blade into different angles of external extension relative to the central axis of said body.

8. An arrowhead in accordance with claim 7 which includes a plurality of said blades and a plurality of said slots having respective said blades pivotally mounted therein, said collar including a plurality of sets of said camming surfaces with said surfaces of each said set being aligned with respect to said blade edges for at least one rotary orientation between said body and said collar.

9. In an arrowhead attachable to an end of an arrow shaft for pivotally and movably mounting at least one elongated, flat blade, the improvement comprising:

a collar having a forward face, a rear portion and a central bore with said rear portion being attached to the end of the arrow shaft so that said central bore is in alignment with the central axis of the arrow shaft, and an elongated body having first and second ends with a piston member on said second end for coaxial sliding movement within said collar bore and at least one slot opening into said body with the external opening of said slot being generally parallel to the length of said body, said body having means mounting the blade for pivotal movement within said slot and around an axis transverse to said slot, said mounting means being positioned for causing an edge of the blade to engage said collar forward face so as to cam the blade outwardly from said body as said piston member moves into said bore.

10. An improved arrowhead in accordance with claim 9 wherein said collar forward face includes a bevel edge forming a conical shape sloping towards said bore.

11. An improved arrowhead in accordance with claim 9 wherein said collar has a plurality of camming surfaces capable of producing different angular orientations of the blade with respect to the central axis of said body when the blade is pivoted outwardly from said body, said piston member being rotatable within said collar bore and each said camming surface being alignable with an edge of the blade for at least one rotational orientation between said piston member and said collar bore.

12. An improved arrowhead in accordance with claim 11 wherein said body includes a plurality of said slots for receiving respective ones of a plurality of blades, said slots being equally spaced circumferentially around said body.

13. An improved arrowhead in accordance with claim 9 wherein said body includes a radial shoulder facing said rear portion and in a position intermediate of said rear portion and said mounting means, and a sleeve having an equivalent weight of the blade with said sleeve having a bore for internally receiving said piston member, said sleeve having a length for abutting said radial shoulder and said collar forward face for retaining said body in an outward extended position relative to said collar.

14. An improved arrowhead in accordance with claim 9 wherein said body is of a generally truncated cylinder configuration tapered towards said first end, said slot being offset from but parallel to the central axis of said body, and extending into said body at a point perpendicular to said pivotal axis for a distance greater than the radius of said body.

15. An improved arrowhead in accordance with claim 9 wherein said piston member includes means for engaging the rear radial face of said collar rear portion for preventing said piston member from being withdrawn from said collar bore, said body including a piercing tip removably attached to said first end thereof.

16. An arrowhead attachable to an end of an arrow shaft for impacting a target comprising:

an elongated body having first and second ends with said second end being attachable to the arrow shaft and so that the length of said body is in alignment with the length of the arrow shaft, said body including a plurality of slots extending into said body intermediate of and with the external openings thereof generally perpendicular to said first and second ends, a plurality of flat blades each having a pair of spaced elongated edges, said blades being pivotally mounted at one end in repective said slots with each said blade having a cutting edge formed on one of said elongated edges and with the opposite said elongated edge being configured at said pivotal mounted end for conforming to the contour of said slots in the region between said pivotal mounting and said elongated body second end, said blades each being pivotable within the associated said slot between a first position wherein said cutting edge is closest to and generally parallel to the central axis of said body and a second position wherein the other said blade elongated edge is blocked from further rotation by said contour region of the associated said slot in proximity to said body second end for holding said blade in an outwardly extended position relative to the external surface of said body, means extending forwardly of said body and the forwardmost point of said blades when said blades are in said first position for initially contacting the target, said initial contacting means including means for applying at least an initial rotational force to each of said blades in the direction of said second position, and means yieldably retaining said blades in said first position and being responsive to said forwardly extending means upon impacting of a target for releasing said blades for rotation within said slots.

17. An arrowhead in accordance with claim 16 wherein said arcuate slots extend into said body in offset but generally parallel relation to the central axis of said body.

18. An arrowhead in accordance with claim 16 wherein said forwardly extending means includes a cap having a plurality of grooves for receiving the ends of said blades opposite said pivotally mounting ends.

19. An arrowhead in accordance with claim 18 wherein said yieldable retaining means includes frangible sidewalls along the external portion of said cap grooves, said cap being formed in a generally conical shape with said grooves opening rearwardly of the tip thereof.

20. An arrowhead in accordance with claim 16 wherein said blades each include a hole transversely therethrough in proximity to the end opposite said pivotally mounted end, said forwardly extending means including an assembly having a plurality of arms with a common junction at one end thereof so that said common junction extends beyond the ends of said blades in said first position and in the direction of the central axis of said body, said yieldable retaining means including a plurality of stubs positioned on respective other ends of said arms with said stubs fitting within respective said blade holes, said assembly being adapted so that impact of said common junction with a target effects pivotal movement of said blades.

21. An arrowhead attachable to an end of an arrow shaft for impacting a target comprising:

an elongated body having first and second ends with said second end being attached to the arrow shaft and so that the length of said body is in alignment with the length of the arrow shaft, said body including a plurality of arcuate slots extending into said body intermediate of and with the external openings thereof generally perpendicular to said first and second ends, a plurality of flat blades each having a pair of spaced elongated edges, said blades being pivotally mounted at one end in respective said slots with each said blade having a cutting edge formed on one of said elongated edges, said blades each being pivotable within the associated said slot between a first position wherein said cutting edge is closest to and generally parallel to the central axis of said body and a second position wherein the other said blade elongated edge is blocked from further rotation at a location in the associated said slot in proximity to said body second end for holding said blade in an outwardly extended position relative to the external surface of said body, said blades each having a notch opening thereinto from said other elongated edge, and means yieldably retaining said blades in said first position and being responsive to impacting of a target for releasing said blades for rotation within said slots, said yieldable retaining means including a band interconnectably received in said blade notches.

22. In an arrowhead assembly attachable to the end of an arrow shaft, apparatus for pivotally mounting flat arrowhead blades at one end portion thereof comprising:

a solid elongated body having the central axis thereof aligned with the central axis of the arrow shaft when the arrowhead is attached to the arrow shaft, at least one slot opening into the outer surface of said body with the opening of said slot being generally parallel to but in offset relation to said central axis, said slot extending into said body for a distance greater than the perpendicular spacing between said central axis and the outer surface of said body at the location of said opening, and means cooperative with the one end portion of the flat blade for pivotally mounting the blade for rotation within said slot and about an axis perpendicular to said slot.

23. Apparatus in accordance with claim 22 wherein said body cross-section is circular relative to said central axis, said body including a plurality of said slots equally spaced around the circumference of said body and each having a depth greater than the radial thickness of said body.

24. Apparatus in accordance with claim 23 wherein the bottom wall of each said slot within said body defines a segment of an arc.

25. A blade for use with an arrowhead body comprising substantially flat first and second interconnected end portions, said first end portion having means for pivotal mounting for rotary movement around an axis substantially perpendicular to the flat surfaces of said first end portion and in spaced relation from the terminal edge of said first end portion, said first end portion terminal edge being formed as a segment of an arc, said first end portion including first and second side edges extending from said terminal edge with said first side edge being formed as a radius edge such that a line perpendicular to any segment thereof in the plane of said first end portion is offset from the axis of rotation of said pivotal mounting means throughout the length of said first side radius edge with said offset being in the direction of said second end portion, and said second end portion having first and second side edges, said first side edges of said first and second end portions being interconnected with said first end portion so as to form an angle therewith greater than 90° but less than 180°.

26. An arrowhead blade in accordance with claim 25 wherein said first side edge and said terminal edge of said first end portion are joined in the form of an inwardly extending notch forming an edge oriented substantially transverse to the direction of rotation of said first end portion around said pivotal mounting means axis.

27. An arrowhead blade in accordance with claim 26 which further includes a plurality of said notches arrayed along said first side edge of said first end portion.

28. An arrowhead blade in accordance with claim 25 wherein said first end portion includes a nub extending transversely therefrom in the same general direction as said pivotal mounting means axis.

29. An arrowhead blade in accordance with claim 25 wherein said first side edge of said first end portion is formed as a segment of an arc, said terminal edge of said first end portion is formed as a segment of an arc centered on said bore thereof, and said second side edges of said first and second end portions are formed as a continuous cutting edge for said blade.

30. An arrowhead blade in accordance with claim 29 wherein the terminal edge of said second portion has a notch extending thereinto in sloping relation towards said first edge of said second end portion.

* * * * *